US006598441B1

(12) United States Patent
Cavaliere et al.

(10) Patent No.: US 6,598,441 B1
(45) Date of Patent: Jul. 29, 2003

(54) METHOD FOR FORMING METAL PARTS BY COLD DEFORMATION

(75) Inventors: David Cavaliere, Montataire (FR); Denis Begue, Bresles (FR)

(73) Assignee: Dacral S.A., Creil (FR)

( * ) Notice: Subject to any disclaimer, the term of this patent is extended or adjusted under 35 U.S.C. 154(b) by 0 days.

(21) Appl. No.: 09/936,459

(22) PCT Filed: Mar. 15, 2000

(86) PCT No.: PCT/FR00/00630

§ 371 (c)(1),
(2), (4) Date: Dec. 21, 2001

(87) PCT Pub. No.: WO00/54907

PCT Pub. Date: Sep. 21, 2000

(30) Foreign Application Priority Data

Mar. 15, 1999 (FR) ..... 99 03155

(51) Int. Cl.[7] ..... B21D 53/10; B05D 1/12
(52) U.S. Cl. ..... 72/47; 72/42; 72/43; 72/53
(58) Field of Search ..... 72/53, 43, 42, 72/47

(56) References Cited

U.S. PATENT DOCUMENTS

| | | | | | |
|---|---|---|---|---|---|
| 3,574,658 | A | * | 4/1971 | Fulk et al. | 72/43 |
| 3,754,976 | A | * | 8/1973 | Babecki et al. | 72/53 |
| 4,228,670 | A | | 10/1980 | Corti et al. | |
| 4,457,150 | A | * | 7/1984 | Saunders et al. | 72/47 |
| 4,552,784 | A | * | 11/1985 | Chu et al. | 72/53 |
| 4,688,411 | A | * | 8/1987 | Hagita et al. | 72/42 |
| 4,714,622 | A | * | 12/1987 | Omori et al. | 72/53 |
| 4,753,094 | A | * | 6/1988 | Spears | 72/53 |
| 4,876,837 | A | * | 10/1989 | Kelly et al. | 72/180 |

FOREIGN PATENT DOCUMENTS

| | | |
|---|---|---|
| EP | 177786 | 4/1986 |
| EP | 647505 | 4/1995 |
| GB | 1041620 | 9/1966 |

* cited by examiner

*Primary Examiner*—David Jones
(74) *Attorney, Agent, or Firm*—Wood, Phillips, Katz, Clark & Mortimer

(57) ABSTRACT

The invention concerns a method for forming metal parts by cold deformation, consisting in: (i) mechanically depositing a metal zinc layer on the free surface of the blank of the part to be produced; and (ii) forming said part by plastic deformation.

11 Claims, 1 Drawing Sheet

METHOD FOR FORMING METAL PARTS BY COLD DEFORMATION

Figure 1:
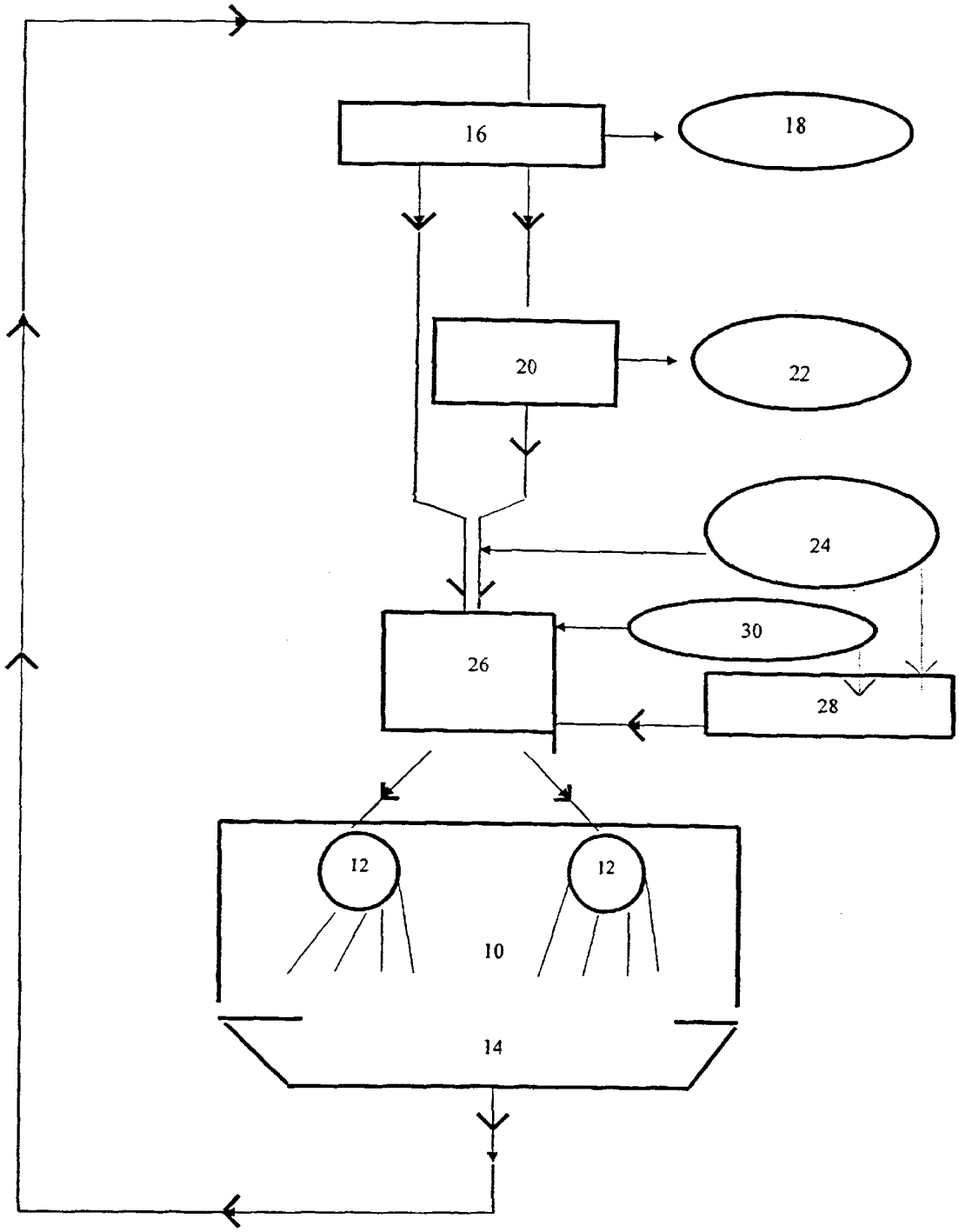

The present invention relates in general to the forming of metal workpieces by cold deformation.

Among the various cold-forming processes, mention may first of all be made of metal extrusion or cold forging, which corresponds to a forming process consisting in making the mass of metal flow under a compressive force between a punch and a die. In this way it is possible to obtain various workpieces of well-defined geometrical shape. This type of deformation requires vertical or horizontal presses comprising one or more work stations equipped with transfers or not.

Another cold-deformation technique, similar to extrusion, is known as cold pressing. In this case, one or more deformation steps are carried out in a single machine, generally horizontal machines comprising one or more stations. These workstations are generally fed with a metal wire which undergoes plastic deformation under forces which are generally lower than in the case of actual extrusion.

Finally, mention may be made, by way of example of a cold-forming process, of wire drawing, which in fact constitutes an intermediate or preliminary preforming step, starting from a reel of wire in order to obtain lengths of smaller diameter, generally intended to feed a cold-pressing station. This type of deformation is used mainly upstream of the manufacture of screws and bolts.

This cold-forming technology is applicable to a very large number of steels and generally nonferrous alloys. In general, the operations are carried out at ambient temperature starting with slugs, blanks or preforms that have undergone a specific preparation operation.

By way of example of types of cold deformation possible, mention may be made of flattening, preforming, forward extrusion or reverse extrusion, hollow or "enfilade" forward extrusion, lateral extrusion, stretching, upsetting, sizing or even cone forming.

Extrudable steels capable of undergoing such cold deformations fall within various categories, especially general-purpose nonalloy steels, but preferably special nonalloy steels for heat treatments, generally fine carbon steels, special alloy steels for heat treatments, stainless steels or microalloy steels. The latter can be cold formed without annealing and acquire, by cold working, high mechanical strength levels while still retaining an acceptable residual ductility.

One of the main difficulties to solve in the context of this technology of the cold deformation of metal workpieces is the need to have to carry out, before forming, surface pretreatments usually involving successive operations which are quite lengthy and expensive, and sometimes relatively difficult to implement, and the effectiveness of which is not entirely satisfactory.

The quality of the surface treatments, for example treatments specific to extrusion, determines the good result obtained after the deformation operations. The essential aim of these surface treatments before forming is, of course, to reduce as far as possible the friction forces exerted in the tooling.

It is precisely the forces involved in cold-forming operations of this type which constitute the major obstacle to the development of these extrusion techniques.

It is therefore essential to be able to reduce the friction forces so as to prevent seizure of the workpiece as far as possible, to reduce the load needed for extrusion and to minimize the wear of the tooling.

These pretreatment operations, mainly based on the lubrication of slugs or preforms, may have to be carried out between two successive deformation operations, whether or not the workpieces undergo an annealing operation.

In the case of carbon steels or low-alloy steels, the pretreatment firstly involves alkaline cleaning and pickling in sulfuric acid in the presence of an inhibitor, the purpose of which is to limit the attack of the metal itself, followed by phosphatizing and finally the actual lubrication.

The purpose of the phosphatizing operation is to form a first, generally porous, adhesion layer of zinc phosphate which is intended to receive the lubricant. Deposition of this lubricant, generally consisting of zinc stearate resulting from the reaction of soaps that react with the zinc phosphate layer, is difficult to control in practice. This is because it is necessary to tailor the thickness of the zinc stearate layer according to the mechanical stresses to which the workpieces to be deformed will be subjected. This tailoring is all the more difficult to control as it involves controlling a chemical reaction which develops at depth within the thickness of the applied layers and the reaction time involved is several hours.

Consequently, the lubrication operation generally involves immersion of the prephosphatized material in hot baths of reactive soaps.

However, this combining between the zinc phosphate layer and the zinc stearate layer may remain insufficient to avoid any contact between the metal workpiece and the tooling.

If the zinc stearate layer is not satisfactory, other, more sophisticated, lubricating products must then be used, which require additional deposition operations, by immersing the workpieces or else by spraying, not only on the workpieces but also on the tooling. Such operations require constant monitoring of the concentration of the lubrication solution and of the application temperature in order to obtain coatings which unfortunately are generally quite irregular.

In the prior art, it has hitherto been regarded as indispensable to carry out a prior phosphatizing step in order to allow both good adhesion and the formation of zinc stearate fulfilling the function of lubricant for the workpiece to be deformed. In a number of applications, and mainly within the context of cold pressing, it is imperative, after forming of the workpiece, to dephosphatize the latter before carrying out the heat treatment in order to avoid any risk of phosphorus diffusing into the steel. Such heat treatments, generally carried out at temperatures of about 850 to 900° C., are essential and actually result in modifications to the structure of the workpieces formed. Such a drawback of the prior art connected with the need to have to carry out a dephosphatizing operation before the heat treatment is particularly serious in the case of the production of screws and bolts, in which problems of embrittlement of the workpieces intended to be subjected to permanent stresses, often resulting in fatigue fractures, are observed.

It is an object of the present invention specifically to reduce, if not to completely eliminate, the abovementioned drawbacks. The subject of the invention is more particularly a process for forming metal workpieces by cold deformation, in a first operation of mechanically depositing a layer based on metallic zinc on the free surface of the workpiece to be produced, it being possible for this layer optionally to contain and/or to be coated with a layer of lubricant, in order subsequently to carry out the forming of said workpiece by plastic deformation of the metal.

Such a cold-forming process has allowed the plastic deformation phenomena to be greatly facilitated by reducing the friction forces involved, and possibly even going as far as reducing the number of intermediate steps during the forming procedure.

The process according to the invention makes it possible to overcome all the drawbacks connected with the use of a phosphatizing pretreatment of the metal blanks or slugs. Finally, it proves to be the case that certain workpieces produced by such a forming process, involving mechanical predeposition of a layer based on metallic zinc, make it possible to obtain workpieces whose fatigue lifetime is improved.

Depending on the forming process used, it may be sufficient to deposit on the metal slug only a single layer based on metallic zinc on the free surface of the latter. Such a layer, made of zinc or more generally of a zinc-iron alloy, or even a mixture of zinc and iron particles, may be applied within the context of the present invention in an amount of between 50 and 250 mg/dm$^2$ of add-on metal. For certain special applications, smaller deposited amounts may even be satisfactory.

Such a layer may be sufficient itself to fulfill the lubrication function for cold-forming operations during which the metal is plastically deformed by relatively low forces.

Advantageously, the layer based on metallic zinc is mechanically deposited by a shot blasting operation with the aid of steel shot having at least one outer layer comprising either pure zinc or a zinc-based alloy.

Such mechanical deposition of a layer based on metallic zinc may also be carried out by a shot blasting operation with the aid of a mixture of steel shot and shot consisting of a steel core and having, on the surface, at least one outer layer based on a zinc alloy or an outer layer of pure zinc.

Finally, this mechanical deposition of the layer based on metallic zinc may also be obtained by shot blasting with the aid of shot based essentially on an iron alloy, the blasting being performed in the presence of a zinc powder or zinc semolina, which is therefore applied due to the mechanical effect of the blasting.

The term "shot" or "microshot" used within the context of the present invention to describe the shot blasting operations should be understood within the broad sense, that is to say they encompass all types of shapes of particles or microparticles to be blasted onto the surface of the workpieces.

The shot blasting machine used to form this first layer on the metal slugs or preforms to be deformed may, for example, be constructed in accordance with the schematic diagram illustrated in the appended FIG. 1.

This figure shows that the machine basically comprises a shot blasting chamber 10 which may, for example, have two blasting turbines 12 between which the workpieces to be treated run. The blasting turbines 12 therefore blast the microshot, made of iron alloy or zinc-based alloy, onto the surfaces of the workpieces to be treated, where appropriate in the presence of a zinc powder or semolina. The lower part of this shot blasting chamber 10 is equipped with a device 14 for recycling the blasting shot. Next, this shot is taken to a particle size separator 16 so as to separate the shot particles which have become too small in diameter. Thus, in particular metal dust 18 generated by the blasting operation is removed. If only shot coated with a zinc-based alloy is used, after shot particle-size sorting the shot is taken to a magnetic separator 20 which makes it possible to sort between steel shot covered with a zinc-based alloy and steel shot depleted of zinc, that is to say shot which has lost most of this zinc-based alloy; the zinc-depleted steel shot is recovered in the station 22. After this magnetic separator 20, a device 24 for measuring the zinc content of the blasting shot is also provided.

Depending on this zinc content measurement, the tank 26 of microshot, which is intended to feed the blasting turbines 12 of the shot blasting device 10, may or may not be resupplied with fresh shot at 28, that is to say shot which is charged or recharged with zinc. Advantageously, the tank 26 is also equipped with a level control system 30.

It is therefore possible in this way for the layer based on metallic zinc to be mechanically deposited, in a continuous or discontinuous manner, on the surface of the slugs or blanks to be formed.

Thus, a layer based on zinc and/or a zinc-iron alloy or on a mixture of zinc and iron is deposited on the surface of the metal slugs or blanks in an amount of 50 to 250 mg/dm$^2$. This layer is not compact in nature since it results in fact from the aggregation of a multitude of zinc and/or iron particles, which therefore gives it a kind of microporous or aerated structure. For some cold-forming operations, this single layer may be sufficient to have an effective lubricating function before the actual forming operation.

For other applications, involving the forming of workpieces of more sophisticated shape and structure, it may prove to be necessary to apply a layer of lubricant to the previously deposited layer based on metallic zinc. The lubricant is preferably applied in a liquid form, allowing it to be well impregnated into the base layer. Depending on the amount of lubricant applied, a kind of saturation of the previous layer based on metallic zinc, or a more complete coating as an overthickness of the latter, will be observed. The amount of lubricant applied will therefore also vary depending on the nature and on the precise shape of the workpieces to be produced. In practice, it turns out that such an amount of lubricant can be effectively applied in an amount possibly of up to 300 mg/dm$^2$.

The layer of lubricant is preferably applied in liquid form, either by spraying or by dipping. The lubricant may in particular be applied in the form of an aqueous suspension based on graphite particles. However, it is perfectly possible to envisage replacing graphite with other lubricants, such as molybdenum disulfide or Teflon, or even aqueous solutions of copolymers such as styrene-maleic acid anhydride copolymers in an ethoxylated alcohol medium.

Finally, it is also possible to use an aqueous polypropylene composition to which has optionally been added graphite powder, boron nitride, polytetrafluoro-ethylene, talc powder, zinc stearate and/or molybdenum disulfide.

The viscosity of these solutions, suspensions or emulsions will be conventionally adjusted in a manner known per se by adding the necessary amounts of emulsifier and/or of thickener. Finally, it is also possible to add to these lubrication liquids additives which provide further protection of the metal workpieces.

After applying the layer based on metallic zinc, optionally followed by application of the layer of lubricant, the metal blank is then subjected to the forming operation which will mainly be a cold-forging, cold-pressing or wire-drawing operation.

In practice, it has been possible to produce components such as drive shafts and turbine shafts, by considerably reducing the friction and deformation phenomena often observed in the prior art.

Such components of relatively complex shape were produced by cold forging using an 8000 kN press.

It will also be recalled that the cylindrical blanks used to produce these components may be directly subjected to the first operation of mechanically depositing the layer based on metallic zinc by a shot blasting operation, without it being necessary to carry out the operations of preparing said metal blank, as in the prior art.

As a variant, it should be pointed out that the process according to the invention may optionally combine two operations—mechanical deposition of a zinc-based layer and application of lubricant—during one and the same step. Thus, it may be envisioned to carry out the mechanical deposition of zinc by blasting with shot based on an iron alloy in the presence of zinc powder or semolina mixed directly with a lubricant in solid form, also in the pulverulent state, for example PTFE or molybdenum disulfide.

To demonstrate the advantages afforded by the process of the invention in comparison with a conventional phosphatizing pretreatment, the results of comparative friction simulation tests, in which a specimen of steel 21 B3 undergoes localized plastic deformation using an indenter made of G30 tungsten carbide, are given below. The conditions for this compression-translation test are used to simulate extrusion and wire drawing, which are two conventional operations very representative of the forming of metal workpieces by cold deformation.

The precise experimental conditions for this test are, for example, recalled in the work entitled: "*Vortragstexte des Symposiums, Neuere Entwicklungen in der Massivumbormung in Fellbach bei Stuttgart*, am 19. und 20. Mai 1999, unter der Leitung von Prof. Dr.-Ing. Dr. h.c. Klaus Siegert, Institut für *Umformtechnik der* Universität Stuttgart, in Zusammenarbeit mit der Deutschen Gesellschaft für Materialkunde e.V., 1999 by MAT-INFO Werkstoff-Informationsgesellschaft mbH Hamburger Allee 26, D-60486 Frankfurt [Lectures from Symposia: Latest Developments in Forming, Fellbach, near Stuttgart, on 19–20 May 1999, run by Prof. Dr.-Ing. Dr. h.c. Klaus Siegert, Institute for Forming Technology of Stuttgart University, in cooperation with the German Society for Materials. e.V., 1999 by MAT-INFO Materials-Information Society mbH, Hamburger Allee 26, D-60486 Frankfurt].

Comparative Tests Relating to the Friction Coefficient $\mu^{**}$ phosphatizing+soap, compared with mechanical deposition of zinc+lubricant in the form of an aqueous graphite suspension.

| Average of the friction coefficients, calculated for friction lengths of between 5 and 35 mm | Wire-drawing: CSR* = 14.7%, plast. strain 0.18, contact pressure = 800 MPa | Wire-drawing + forward extrusion: CSR* = 14.7%, plast. strain 0.18, contact pressure = 800 MPa; CSR* = 31%, plast. strain 0.80, contact pressure = 1380 MPa |
|---|---|---|
| Phosphatizing + reactive soap | $\mu = 0.062$ | $\mu = 0.10$ |
| Mechanical deposition of zinc + lubricant in the form of an aqueous graphite suspension | $\mu = 0.054$ | $\mu = 0.085$ |

Comparative Tests Relating to the Friction Coefficient $\mu^{**}$ phosphatizing+soap+extrusion oil, compared with mechanical deposition of zinc+lubricant in the form of an aqueous graphite suspension+extrusion oil.

The oil used was an MHE 68 oil meeting the specifications of the ISO 6743/7 standard.

| Average of the friction coefficients, calculated for friction lengths of between 5 and 35 mm | Wire-drawing + forward extrusion: CSR* = 14.7%, plast. strain 0.18, contact pressure = 800 MPa; CSR* = 31%, plast. strain 0.80, contact pressure = 1380 MPa |
|---|---|
| Phosphatizing + reactive soap + pressing oil during extrusion | $\mu = 0.12$ |
| Mechanical deposition of zinc + lubricant in the form of an aqueous graphite suspension + pressing oil during extrusion | $\mu = 0.082$ |

*CSR = cross-section reduction ratio
CSR = 100 $(di^2 - df^2)/(di^2)$
with di = initial diameter and
df = final diameter;
**$\mu$ denotes the friction coefficient, which represents the ratio of the translation force (Ft) lying in the direction tangential to the displacement of the indenter to the compressive force (Fn) exerted by the indenter in the normal direction.

Variations of the process according to the invention were made based on modifications to the weight of the mechanical zinc coating layer. These variations were made between 0 mg/dm$^2$ and 200 mg/dm$^2$.

The results of the study show that for simple wire-drawing operations, a zinc layer weight of 50 mg/dm$^2$ seems to be sufficient in practice.

On the other hand, for sequenced operations of wire drawing followed by front extrusion, a layer weight of between 50 mg/dm$^2$ and 100 mg/dm$^2$ seems to represent an optimization of the process according to the invention.

What is claimed is:

1. A process for forming metal workpieces by cold deformation, which process comprises steps of:

i) mechanically depositing a layer based on metallic zinc on a free surface of a blank of a workpiece to be produced;

ii) applying a layer of lubricant on the layer based on metallic zinc; and iii) forming said workpiece by plastic deformation.

2. The process as claimed in claim 1, in which process the layer based on metallic zinc is mechanically deposited by blasting with shot having at least one outer layer comprising a zinc based alloy.

3. The process as claimed in claim 1, in which process the layer based on metallic zinc is mechanically deposited by blasting with a mixture of shot made of an iron-based alloy and shot having at least one outer layer comprising a zinc-based alloy.

4. The process as claimed in claim 1, in which process the layer based on metallic zinc is mechanically deposited by blasting with shot based on an iron alloy in the presence of zinc powder.

5. The process as claimed in any one of claims 1, 2, 3, and 4, in which process the layer of lubricant is applied in liquid form, particularly by the application of a liquid suspension based on graphite particles.

6. The process as claimed in any one of claims 1, 2, 3, and 4, in which process the layer of lubricant is applied in solid form, particularly in the form of molybdenum disulfide or polytetrafluoroethylene.

7. The process as claimed in any one of claims 1, 2, 3, and 4, in which process the mechanically deposited coating forming a layer based on metallic zinc consists of zinc particles, a mixture of zinc particles and iron particles, or else particles of zinc-iron alloys, which particles are deposited in an amount of 50 to 250 $mg/dm^2$.

8. The process as claimed in any one of claims 1, 2, 3, and 4, in which process the layer of lubricant is applied in an amount up to 300 $mg/dm^2$.

9. The process as claimed in any one of claims 1, 2, 3, and 4, in which process the cold formation is a cold-pressing operation.

10. The process as claimed in any one of claims 1, 2, 3, and 4, in which process the cold formation is a cold-forging operation or a metal extrusion operation.

11. The process as claimed in any one of claims 1, 2, 3, and 4, in which process the cold formation is a wire-drawing operation.

* * * * *